US012426650B2

(12) United States Patent
McKenna

(10) Patent No.: US 12,426,650 B2
(45) Date of Patent: Sep. 30, 2025

(54) BIKINI WITH DETACHABLE SKIRT

(71) Applicant: Gianine LLC, Atlanta, GA (US)

(72) Inventor: Gianine McKenna, Atlanta, GA (US)

(73) Assignee: Gianine LLC, Atlanta, GA (US)

( * ) Notice: Subject to any disclaimer, the term of this patent is extended or adjusted under 35 U.S.C. 154(b) by 0 days.

(21) Appl. No.: 18/651,985

(22) Filed: May 1, 2024

(65) Prior Publication Data

US 2024/0407480 A1 Dec. 12, 2024

Related U.S. Application Data

(60) Provisional application No. 63/507,243, filed on Jun. 9, 2023.

(51) Int. Cl.

| | |
|---|---|
| ***A41D 7/00*** | (2006.01) |
| ***A41D 1/14*** | (2006.01) |
| ***A41D 15/00*** | (2006.01) |

(52) U.S. Cl.

CPC ..... *A41D 7/00* (2013.01); *A41D 1/14* (2013.01); *A41D 15/00* (2013.01)

(58) Field of Classification Search

CPC ..... A41D 27/00; A41D 7/00; A41D 7/006; A41D 15/00; A41D 15/002

See application file for complete search history.

(56) References Cited

U.S. PATENT DOCUMENTS

| | | | | | |
|---|---|---|---|---|---|
| 687,765 | A * | 12/1901 | Lundvall | A41F 5/00 | 2/302 |
| 1,087,726 | A * | 2/1914 | Carty | A41B 11/12 | 2/240 |
| 1,364,693 | A * | 1/1921 | Bonheur | A41D 15/00 | D2/750 |
| 1,909,279 | A | 5/1933 | Just | | |
| 2,115,443 | A | 4/1938 | Flesh | | |
| 2,443,474 | A * | 6/1948 | Morgan | A41D 7/005 | 2/407 |

(Continued)

FOREIGN PATENT DOCUMENTS

| | | |
|---|---|---|
| GB | 2557309 B | 6/2020 |
| WO | 9622032 | 7/1996 |

OTHER PUBLICATIONS

PangoPangoSwimwear, https://www.instagram.com/p/CpVNvRCu_bV/, Mar. 3, 2023 (Year: 2023).*

(Continued)

*Primary Examiner* — Heather Mangine

(74) *Attorney, Agent, or Firm* — BEKIARES ELIEZER LLP

(57) ABSTRACT

A garment system may include a bikini top, which may be designed with a cover portion. This cover portion may be configured to cover at least a portion of a wearer's bust. The bikini top may also incorporate one or more attachment points. Additionally, the system may include a detachable skirt. This skirt may have one or more attachment mechanisms, which may be disposed along an upper peripheral edge of the skirt. These attachment mechanisms may be designed to cooperate with the one or more attachment points on the bikini top. This cooperation between the attachment mechanisms and the attachment points may allow the detachable skirt to be detachably connected to the bikini top.

13 Claims, 7 Drawing Sheets

(56) References Cited

U.S. PATENT DOCUMENTS 2,492,396 A * 12/1949 Perlitch ..... A41B 9/06 2/76
2,493,545 A * 1/1950 Muyleart ..... A41D 1/22 D2/756
2,895,480 A * 7/1959 Fixel ..... A41F 17/00 450/111
3,327,714 A * 6/1967 Steinberger ..... A41C 3/08 2/73
3,498,408 A * 3/1970 Foote ..... A41D 13/0007 182/6
3,566,411 A * 3/1971 Gordon ..... A41F 11/18 450/111
4,272,852 A * 6/1981 Bell ..... A41D 3/00 224/257
4,301,545 A * 11/1981 Camarena ..... A41D 7/00 2/67
D278,473 S * 4/1985 Briggery Myles ..... D2/737
4,815,145 A * 3/1989 Chow ..... A41D 7/00 2/72
5,345,613 A * 9/1994 Jones ..... A41B 11/143 2/303
5,628,064 A 5/1997 Chung
5,941,438 A * 8/1999 Price ..... A41F 9/002 224/660
6,185,741 B1 * 2/2001 Kehoe ..... A41D 7/00 2/69
6,212,688 B1 * 4/2001 Leslie ..... A41D 19/0041 2/160
6,240,560 B1 * 6/2001 DeCaro ..... A41B 9/002 2/67
7,513,816 B1 * 4/2009 McCullough ..... A41D 27/08 450/86
8,522,362 B1 * 9/2013 Stones ..... A41D 7/00 450/33
9,220,305 B2 * 12/2015 Hersh ..... A41D 7/00
9,560,889 B1 * 2/2017 White ..... A41D 7/00
10,588,362 B1 * 3/2020 Alexei ..... A45C 3/06
10,602,783 B1 * 3/2020 Colligan ..... A41D 15/04
11,185,115 B2 11/2021 Fahey
11,857,007 B1 * 1/2024 Dew ..... A41D 13/04
11,992,074 B2 * 5/2024 Wenkman ..... A41F 17/00
2002/0042937 A1 * 4/2002 Green ..... A44C 5/2004 2/300
2004/0128733 A1 * 7/2004 Hendricks ..... A41D 7/00 2/69
2004/0181857 A1 * 9/2004 Brinks ..... A42B 7/00 2/424
2006/0039165 A1 * 2/2006 Harris ..... A41D 27/085 362/605
2009/0055991 A1 * 3/2009 Johnson ..... A45C 9/00 2/84
2009/0126072 A1 * 5/2009 Allen ..... A41D 7/00 2/82
2010/0058508 A1 * 3/2010 Hersh ..... A41D 7/00 2/243.1
2010/0122709 A1 * 5/2010 Janatpour ..... A45F 5/00 132/286
2010/0154472 A1 * 6/2010 Unitan ..... A44C 15/0045 63/23
2010/0293700 A1 11/2010 Gillespie et al.
2012/0272427 A1 * 11/2012 Scozzafava ..... A41D 7/00 2/69
2013/0205466 A1 * 8/2013 Arnold ..... A41D 1/00 2/69
2015/0007374 A1 * 1/2015 Larson ..... A41D 15/00 2/67
2015/0173427 A1 * 6/2015 Sawyer ..... A41D 15/002 2/67
2015/0320123 A1 * 11/2015 Kosmala ..... A44C 5/0007 2/67
2016/0037837 A1 * 2/2016 Ferrara ..... A41D 7/00 450/1
2016/0143372 A1 * 5/2016 Anderson ..... A41D 7/00 450/31
2016/0165963 A1 * 6/2016 Buescher ..... A41C 3/12 450/1
2017/0006939 A1 1/2017 Moctezuma et al.
2017/0013922 A1 * 1/2017 Vlad-Berindan ..... B44C 5/06
2017/0028244 A1 * 2/2017 Schreiber ..... A63B 21/4007
2017/0049165 A1 * 2/2017 Turley ..... A44C 5/2033
2017/0055613 A1 * 3/2017 Dames, III ..... A41F 15/002
2017/0164667 A1 * 6/2017 Street ..... A41D 7/00
2018/0235294 A1 * 8/2018 Salisbury ..... A41D 19/01594
2020/0093199 A1 * 3/2020 Fahey ..... A41D 15/00
2020/0275715 A1 * 9/2020 Beattie ..... A41D 15/00
2020/0335005 A1 * 10/2020 Green ..... A41D 1/04
2022/0061439 A1 * 3/2022 Rhode ..... A41F 17/00
2022/0175069 A1 * 6/2022 Rodriguez, Jr. ..... A45F 5/02
2023/0354925 A1 * 11/2023 Thomas ..... A41D 7/005
2024/0407480 A1 * 12/2024 McKenna ..... A41D 15/00

OTHER PUBLICATIONS

Shein website, "Home / Women Apparel / Women Clothing / Women Beachwear / Women Bikini Sets / 3pack Floral Print Halter Bikini Swimsuit & Detachable Beach Skirt", https://us.shein.com/3pack-Floral-Print-Halter-Bikini-Swimsuit-Detachable-Beach-Skirt, Jun. 1, 2023, 4 pgs.

PangoPango Swimwear website, Triangle Top with New Detachable Bikini Skirt, https://pango-pangoswimwear.com/product/triangle-top-with-new-detachable-bikini-skirt/, Jun. 1, 2023, 3 pgs.

Related U.S. Design Application No. 29/940,302, filed May 1, 2024, Title: Garment With Detachable Skirt, Applicant: Gianine LLC.

Related U.S. Design Application No. 29/940,313, filed May 1, 2024, Title: Garment With Detachable Skirt and Circular Attachment Points, Applicant: Gianine LLC.

* cited by examiner

BIKINI WITH DETACHABLE SKIRT

RELATED APPLICATION

Under provisions of 35 U.S.C. § 119(e), the Applicant claims benefit of U.S. Provisional Application No. 63/507,243 filed on Jun. 9, 2023, and having inventors in common, which is incorporated herein by reference in its entirety.

It is intended that the referenced application may be applicable to the concepts and embodiments disclosed herein, even if such concepts and embodiments are disclosed in the referenced application with different limitations and configurations and described using different examples and terminology.

FIELD OF DISCLOSURE

The present disclosure generally relates to the field of garment design. Specifically, the present disclosure relates to the design of a garment system that incorporates a detachable skirt with a bikini top.

BACKGROUND

In some situations, individuals may wish to transition from a beach or pool setting to a more formal environment without the need for completely changing their attire. For example, a woman may be swimming or sunbathing in a bikini at a beach or pool, and may want to transition to a restaurant or other indoor setting.

The conventional strategy is to carry multiple outfits. This often causes problems because the conventional strategy does not provide a convenient and quick solution. For instance, the individual may not want to carry extra clothing due to space and/or weight constraints, or may not be aware of a suitable place to change. In other situations, a quick transition may be desired, but changing into a different outfit can be time-consuming and inconvenient.

Accordingly, there is a need for a garment that can quickly transition from beach and/or pool settings to more formal settings.

BRIEF OVERVIEW

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

In some embodiments, the garment may include three pieces: a bikini top, a bikini bottom, and a detachable skirt that can be worn over the bikini bottom. The detachable skirt may be removably attached to the bikini top. For example, the bikini top may integrate one or more rings or attachment points, and the detachable skirt may have one or more hooks or clasps that are removably engageable with the attachment points. The hooks may removably secure the skirt to the bikini top, changing the look of the swimsuit and securely holding the skirt in place.

In an embodiment, a garment system may be provided. This system may include a bikini top. The bikini top may have a cover portion. The cover portion may be configured to cover at least a portion of a wearer's bust. The bikini top may have one or more attachment points integrated into it. The system may also include a detachable skirt. The detachable skirt may have one or more attachment mechanisms.

These attachment mechanisms may be disposed along an upper peripheral edge of the skirt. The attachment mechanisms may be configured to cooperate with the one or more attachment points on the bikini top. This cooperation may allow the detachable skirt to be detachably connected to the bikini top.

In another embodiment, a garment may be provided. This garment may include a bikini top. The bikini top may be configured to be worn by a user. The bikini top may have one or more attachment points affixed to it. The garment may also include a bikini bottom. The bikini bottom may be configured to be worn by the user. The garment may further include a detachable skirt. The detachable skirt may have one or more attachment mechanisms. These attachment mechanisms may be configured to cooperate with the one or more attachment points. This cooperation may allow the detachable skirt to be selectively attached to the bikini top. When the detachable skirt is attached to the bikini top, the skirt may cover an abdomen of the wearer and at least a portion of the bikini bottom.

In yet another embodiment, a garment may be provided. This garment may include a bikini top. The bikini top may be configured to be worn by a user to cover at least a portion of the user's bust. The bikini top may include a plurality of metallic rings affixed to it. The garment may also include a bikini bottom. The bikini bottom may be configured to be worn by a user to cover at least a portion of the user's pelvis. The garment may further include a skirt. The skirt may be configured to be selectively worn by a user. The skirt may include a plurality of clasps affixed to it. Each of the clasps may be configured to selectively attach to the bikini top at a corresponding one of the plurality of rings. When the user wears the bikini top and the bikini bottom, and the skirt is attached to the bikini top, the skirt may be configured to cover at least a portion of the bikini bottom.

Consistent with embodiments of the present disclosure, a garment system may be presented. This system may include a bikini top. The bikini top may have a cover portion. The cover portion may be configured to cover at least a portion of a wearer's bust. The bikini top may also integrate one or more attachment points. The system may further include a detachable skirt. The detachable skirt may have one or more attachment mechanisms. These attachment mechanisms may be disposed along an upper peripheral edge of the skirt. The attachment mechanisms may be configured to cooperate with the one or more attachment points on the bikini top. This cooperation may allow the detachable skirt to be detachably connected to the bikini top.

In another embodiment, a garment may be presented. This garment may include a bikini top. The bikini top may be configured to be worn by a user. The bikini top may have one or more attachment points affixed to it. The garment may also include a detachable skirt. The detachable skirt may have one or more attachment mechanisms. These attachment mechanisms may be configured to cooperate with the one or more attachment points. This cooperation may allow the detachable skirt to be selectively attached to the bikini top. When the detachable skirt is attached to the bikini top, the skirt may cover an abdomen of the wearer and at least a portion of a pelvis of the wearer.

In yet another embodiment, a garment may be presented. This garment may include a bikini top. The bikini top may be configured to be worn by a user to cover at least a portion of the user's bust. The bikini top may include a plurality of metallic rings affixed to it. The garment may also include a skirt. The skirt may be configured to be selectively worn by a user. The skirt may include a plurality of clasps affixed to it. Each of the clasps may be configured to selectively attach to the bikini top at a corresponding one of the plurality of rings. When the user wears the bikini top and the skirt is attached to the bikini top, the skirt may be configured to cover at least a portion of a pelvis of the user.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
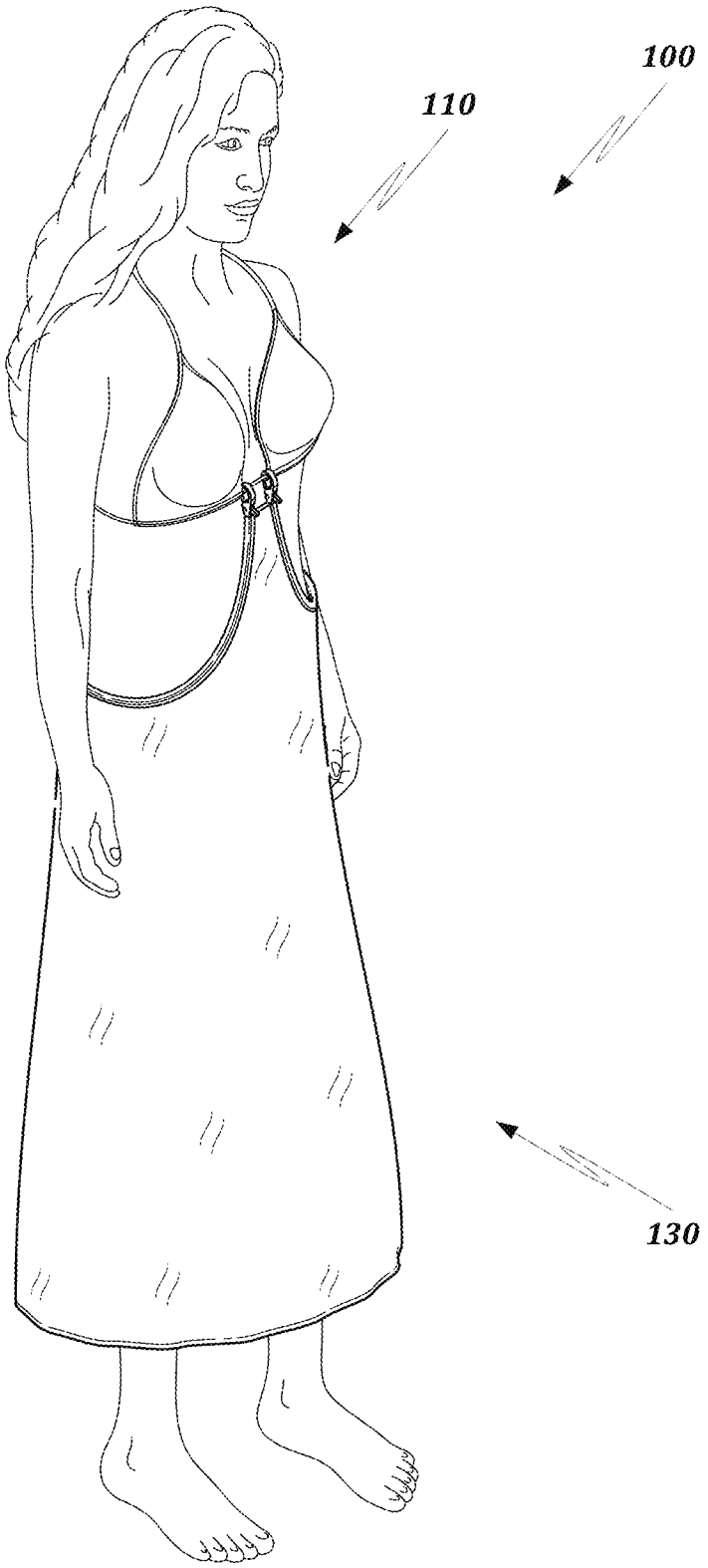
FIG. 1 is an illustration of a wearer wearing a first embodiment of a bikini with detachable skirt.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of a swimwear garment, such as a bikini, with detachable skirt, embodiments of the present disclosure are not limited to use only in this context.

I. GARMENT OVERVIEW

This overview is provided to introduce a selection of concepts in a simplified form that are further described below. This overview is not intended to identify key features or essential features of the claimed subject matter. Nor is this overview intended to be used to limit the claimed subject matter's scope.

A garment may comprise a swimwear garment, such as a bikini. The garment may include a bikini top, a bikini bottom and a detachable skirt. The bikini top may include one or more attachment points (e.g., rings, loops, etc.) affixed to a lower portion of the bikini top. For each attachment point, a corresponding hook or clasp may be affixed to a n upper portion of the detachable skirt.

The hooks or clasps may be easily engageable and disengageable with the attachment points, such that a wearer can easily and quickly attach the skirt to or detach the skirt from the bikini top while the bikini top is being worn, removing the need for finding a private changing to change the look of the garment. When engaged, the hooks securely fasten the detachable skirt to the bikini top, such that a wearer need not worry about the skirt portion slipping down or otherwise moving, as with a conventional coverup wrap or sarong.

In some embodiments, the garment may comprise components comprising, but not limited to, at least one of the following:

A. A Bikini Top;

B. A Bikini Bottom; and

C. A Detachable Skirt.

In some embodiments, the garment may include additional set of components.

Details with regards to each component are provided below. Although components are disclosed with specific functionality, it should be understood that functionality may be shared between components, with some functions split between components, while other functions duplicated by the components. Furthermore, the name of the component should not be construed as limiting upon the functionality of the component. Moreover, each stage disclosed within each component can be considered independently without the context of the other stages within the same component or different components. Each stage may contain language defined in other portions of this specifications. Each stage disclosed for one component may be mixed with the operational stages of another component. In the present disclosure, each stage can be claimed on its own and/or interchangeably with other stages of other components.

The following depicts an example of a method of a plurality of methods that may be performed by at least one of the aforementioned components. Although the stages of the following example method are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed without altering or deterring from the fundamental scope of the depicted methods and systems disclosed herein.

Consistent with embodiments of the present disclosure, a method may be performed by at least one of the aforementioned components. The method may be embodied as, for example, but not limited to, computer instructions, which when executed, perform the method. The method may comprise the following stages:

providing a bikini top and a bikini bottom for wear by a user;

attaching a detachable skirt to the bikini top by engaging one or more hooks or clasps affixed to the detachable skirt with one or more corresponding attachment points affixed to the bikini top, while the bikini top is being worn by the user; and detaching the detachable skirt from the bikini top by disengaging the one or more hooks or clasps affixed to the detachable skirt from the one or more corresponding attachment points affixed to the bikini top, while the bikini top is being worn by the user.

Both the foregoing overview and the following detailed description provide examples and are explanatory only. Accordingly, the foregoing overview and the following detailed description should not be considered to be restrictive. Further, features or variations may be provided in addition to those set forth herein. For example, embodiments may be directed to various feature combinations and subcombinations described in the detailed description.

II. GARMENT STRUCTURE

As shown in FIGS. 1-6, embodiments of the present disclosure provide a garment 100 comprised of a set of components or pieces, including, but not limited to a bikini top 110, a bikini bottom 120, and a detachable skirt 130. In some embodiments, the garment 100 may be designed as swimwear, activewear, lounge wear, resort wear garment, and/or other garment types.

A. A Bikini Top

As shown in FIGS. 1-6, the garment 100 includes a bikini top 110. The bikini top 110 may be formed in various styles and/or from various material (e.g., woven or non-woven fabrics, leather, latex, etc.) without departing from the scope of the invention. Many styles of bikini tops 110 may be consistent with embodiments of the garment 100. The bikini top 110 may be formed in various styles, and may have various colors, patterns, and/or indicia without departing from the scope of the invention.

The bikini top 110 may include a cover portion 112 configured to cover at least a portion of a wearer's bust, as is known in the art. In some embodiments the cover portion 112 may substantially encircle at least a portion of the wearer's body, (e.g., in the bust region, the neck region, the midriff region, etc.).

The bikini top 110 may include one or more attachment points 114 integrated therein. While various embodiments depicted in this application may include two attachment points 114, those of skill in the art will recognize that more or fewer attachment points may be provided without departing from the scope of the invention.

Figure 2:
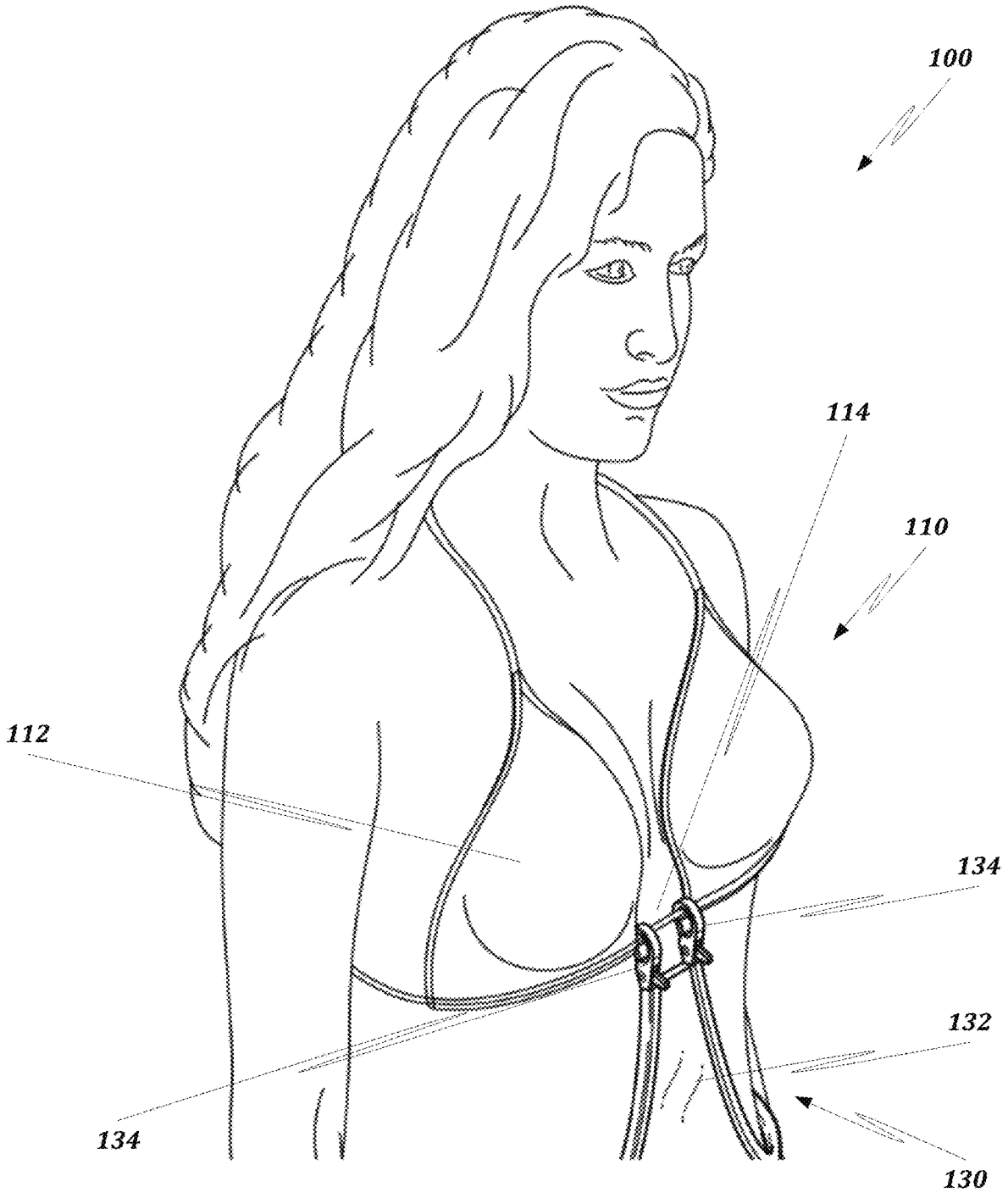
FIG. 2 is an close-up of a wearer wearing the first embodiment of the bikini with detachable skirt.
Figure 3:
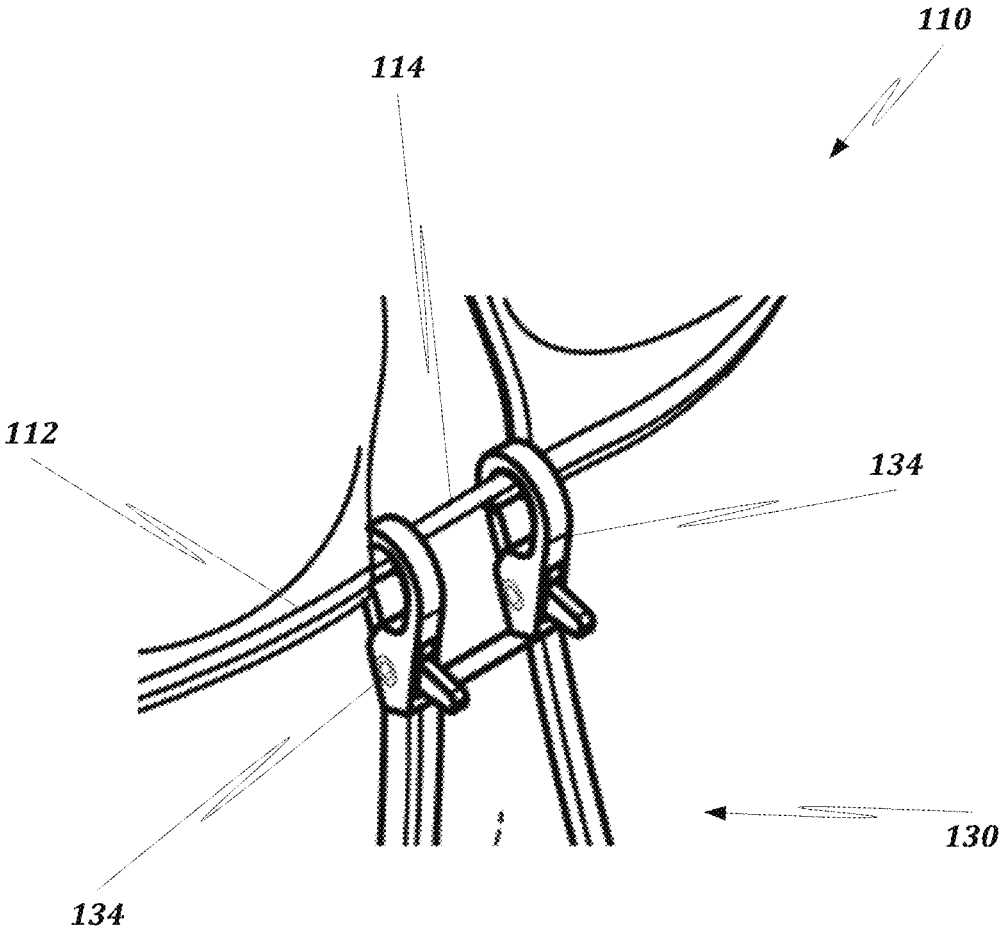
FIG. 3 is an detailed illustration of an attachment mechanism used in the first embodiment of the bikini with detachable skirt.

As shown in FIGS. 1-3, an attachment point 114 may be a portion of the bikini top 110 itself. For example, a triangle-style bikini top 110 may include a cord, string, or strip of material extending across the front, between the two cups that form a part of the cover portion 112 of the bikini top 110. In embodiments, the cord, string, or strip of material may serve as an attachment point 114.

Figure 4:
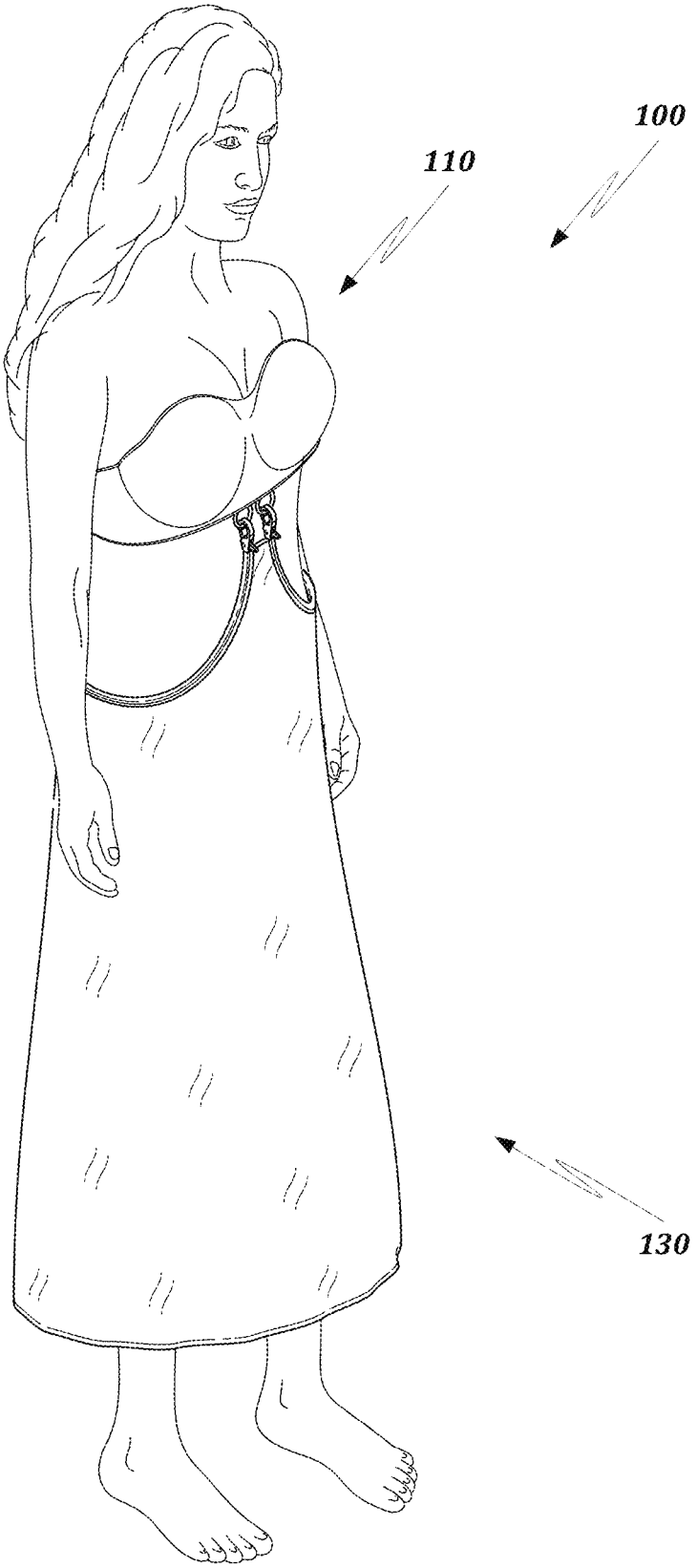
FIG. 4 is an illustration of a wearer wearing a second embodiment of a bikini with detachable skirt.
Figure 5:
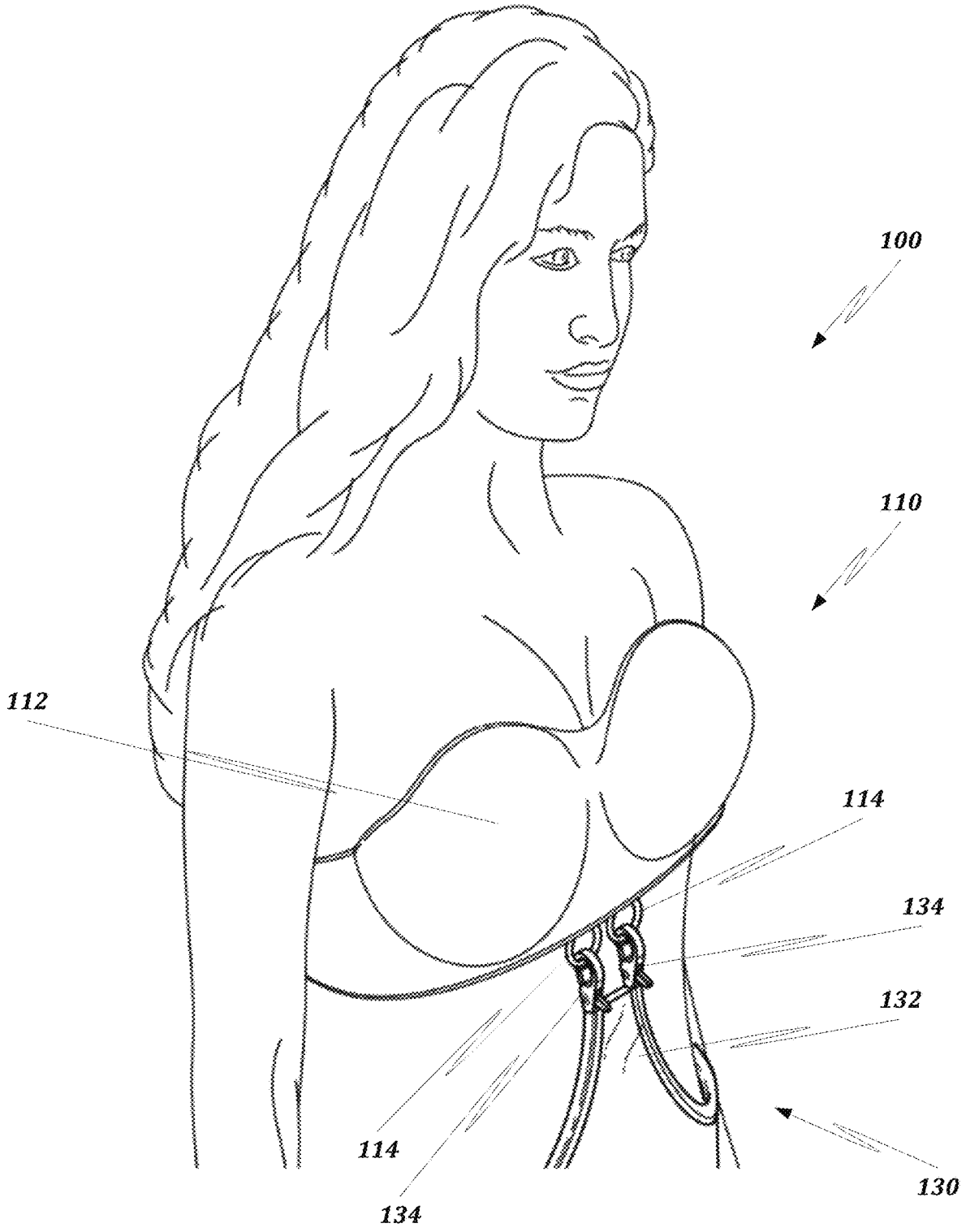
FIG. 5 is an close-up of a wearer wearing the second embodiment of the bikini with detachable skirt.
Figure 6:
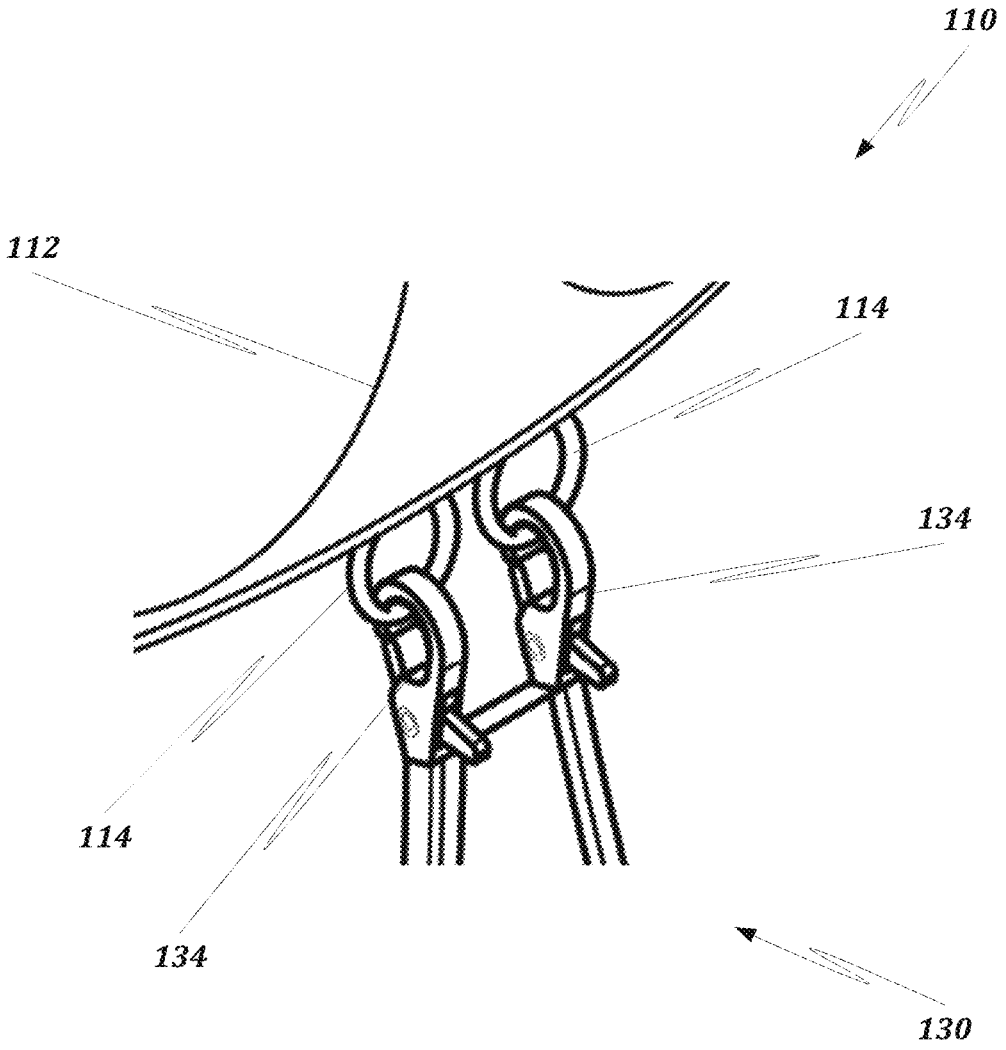
FIG. 6 is a detailed illustration of an attachment mechanism used in the second embodiment of the bikini with detachable skirt.

Alternatively, as shown in FIGS. 4-6, one or more attachment points 114 may be added to the bikini top 110. For example, the one or more attachment points 114 may be affixed to the bikini top 110 by being sewn to the bikini top, pinned to the bikini top, affixed using a chemical adhesive, integrated into a weave of the fabric forming the bikini top, etc. There are many ways in which the attachment point 114 may be affixed to the bikini top 110. As a particular example, one or more (e.g., each) of the attachment points 114 may be formed as a ring. The ring may be made from a durable material such as various metals and/or plastics. Additionally or alternatively, one or more (e.g., each) of the attachment points 114 may be formed as a loop of fabric, an aperture in the fabric (e.g., using a grommet or eyelet formed in the fabric), etc. In this way, additional bikini top styles (e.g., a bandeau, sports bra, tankini, and/or other style) that lacks a thin portion to which the skirt may attach can still be attached to the detachable skirt.

As best shown in FIGS. 5 and 6, the one or more attachment points 114 are preferably formed as metallic rings sewn into a lower portion of the bikini top, below the bust line. For example, the attachment points may be disposed at a lower peripheral edge of the bikini top. However, those of skill in the art will recognize that alternate placements are possible without departing from the scope of the invention. For example, the attachment points 114 may be disposed at any position below the bust line, even when the bikini top 110 extends further down the wearer's midriff (e.g., in the case of a tankini top). The attachment points 114 are preferably disposed at a position of the bikini top 110 such that the detachable skirt 130 hangs at a desirable length for most body types.

B. A Bikini Bottom

The swimwear garment 100 may include a bikini bottom. The bikini bottom may be formed according to a number of cuts and styles. The bikini bottom may be formed from a fabric or material (e.g., fabric, latex, leather, etc.) having any desirable color or pattern thereon. In some embodiments, a color or pattern of the bikini bottom may be chosen to match, complement, or contrast a color or pattern of the bikini top 110. In some embodiments, the bikini bottom may be formed as a separate component, independent of the bikini top 110. In other embodiments, the bikini bottom may be formed integrally with the bikini top 110. In still other embodiments, the bikini bottom may be attached to the bikini top 110 via stitch, adhesive, chemical and/or heat welding, and/or any other process used to attach textile, fabric, and/or material components.

C. A Detachable Skirt

As best shown in FIGS. 1 and 4, the garment 100 may include a detachable skirt 130. The detachable skirt 130 may be formed according to a number of cuts and/or styles. The detachable skirt 130 may be formed from a fabric (e.g., woven and/or non-woven fabric) or material (e.g., latex, leather, etc.) having any desirable color or pattern thereon. In some embodiments, a color or pattern of the detachable skirt 130 may be chosen to match, complement, or contrast a color or pattern of the bikini top 110 and/or the bikini bottom 130. In some embodiments, the detachable skirt 130 may be formed from one or more of a sheer material, a mesh or lace material, and/or any woven or nonwoven fabric.

In embodiments, the detachable skirt 130 may include a midriff portion 132 that extends upward to meet with a portion of the bikini top 110 while being worn. In this way, the midriff portion 132 may cover an abdomen or stomach of the wearer.

The detachable skirt 130 may include one or more attachment mechanisms 134 corresponding to and/or configured to cooperate with the one or more attachment points 114 formed on the bikini top 110 to connect the skirt 130 to the bikini top. In embodiments, the one or more attachment mechanisms 134 may be disposed along an upper peripheral edge or upper hem of the midriff portion 132. In some embodiments, at least one of the one or more attachment mechanisms 134 may be affixed to the detachable skirt 130. Additionally or alternatively, at least one of the one or more attachments mechanisms 134 may be formed integrally with the detachable skirt 130.

In some embodiments, at least one of the one or more attachment mechanisms 134 may be formed as one or more hooks or clasps affixed to the detachable skirt 130. For example, the hooks or clasps may be affixed to the detachable skirt 130 by being sewn to the detachable skirt, pinned to the detachable skirt, affixed using a chemical adhesive, integrated into a weave of the fabric forming the detachable skirt, etc. There are many ways in which the hooks or clasps may be affixed to the detachable skirt 130. One or more (e.g., each) of the attachment mechanisms may be formed as a spring-ring clasp, a lobster claw clasp, a toggle clasp, an S-hook clasp, etc. The attachment mechanisms 134 may be made from a durable material such as various metals and/or plastics. Each hook or clasp may be configured to connect to and be retained by a corresponding attachment point 114 of the bikini to 110.

Additionally or alternatively, in some embodiments at least one of the one or more attachment mechanisms 134 may be formed as a strip or loop of fabric configured to be tied or otherwise enmeshed with a corresponding attachment point 114 on the bikini top 110.

Additionally or alternatively, at least one of the one or more attachment mechanisms 134 may be formed as a channel adjacent to the upper peripheral edge or upper hem of the detachable skirt 130. In some embodiments, the channel may be formed as a permanent structure in the skirt 130. As one example, stitching may be used to form the channel. Alternatively, the channel may be temporarily formed using a temporary means of affixing one portion of the skirt to another (e.g., hook and loop fasteners, snaps, buttons, zippers, etc.) creating a fold that defines the temporary channel. In embodiments, the channel may be configured to receive and retain one or more of the attachment points 114 within the channel, thereby retaining the detachable skirt 130 on the bikini top 110. As one example, where the attachment point 114 is a cord or string extending between cups on a bikini top 110, the cord or string may be retained within the channel, such that the detachable skirt 130 is detachably retained on the bikini top 110.

Each attachment mechanism 134 may be engageable with at least one corresponding attachment point 114 on the bikini top 110 to retain the detachable skirt 130 in connection to the bikini top 110. The one or more attachment mechanisms 134 on the detachable skirt 130 may be easily engageable and/or disengageable with the attachment points 114 on the bikini top 110, such that a wearer can easily and quickly attach and/or detach the skirt 130 from the bikini top 110 based on the needs and/or desires of the wearer.

III. GARMENT USE

Embodiments of the present disclosure provide a garment usable by a set of methods. The following depicts an example of a method of a plurality of methods that may be performed using the garment.

Although the stages of the following example method are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed from the without altering or deterring from the fundamental scope of the depicted methods and systems disclosed herein.

Figure 7:
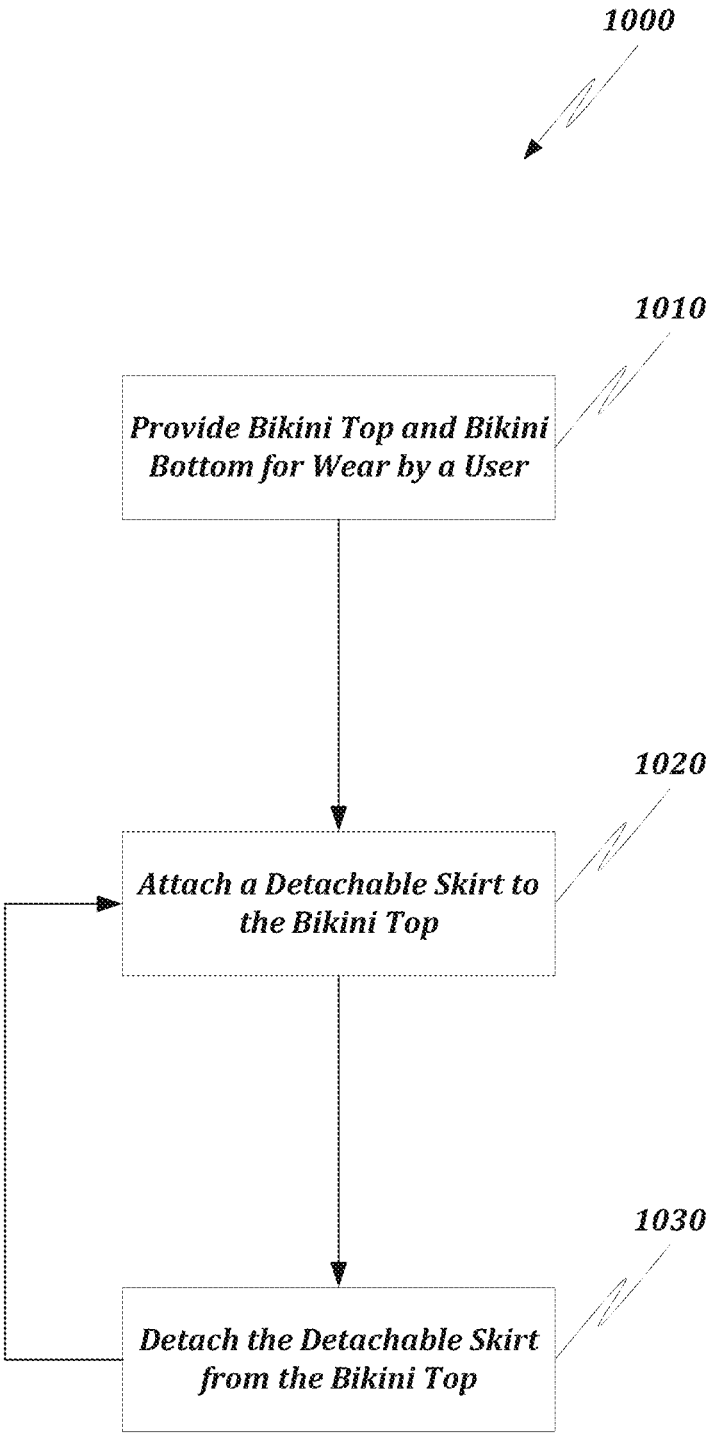
FIG. 7 is a flowchart showing a method of use of the bikini with detachable skirt.

Consistent with embodiments of the present disclosure, as shown in FIG. 7, a method 1000 may be performed by at least one of the aforementioned components of the swimwear garment. The method may comprise the following stages:

In a first stage 1010, the user may be provided with a bikini top and bikini bottom for wear by the user. The bikini top and bikini bottom may be of any type suitable for wear by the user, and may be formed from a variety of materials, in a variety of styles and/or patterns.

In stage 1020, a user may attach a detachable skirt to the bikini top. For example, the user may engage one or more hooks or clasps affixed to the detachable skirt with one or more corresponding attachment points of the bikini top. In some embodiments, the one or more attachment points may be formed as a part of the bikini top. Alternatively or additionally, at least one of the one or more attachment points may be formed as a separate structure affixed to the bikini top. For example, the at least one attachment point may be a ring, a loop of fabric, or another object to which the clasp may connect. In this way, the skirt may be added to the bikini top without the need to change outfits completely.

In stage 1030, the user may detach the detachable skirt from the bikini top by disengaging the one or more hooks or clasps affixed to the detachable skirt from the one or more corresponding attachment points of the bikini top. In this way, the skirt may be removed from the bikini top without the need to change outfits completely. Thereafter, the method may return to stage 1020.

Consistent with embodiments of the present disclosure as shown in FIG. 1-6 a user may wear the swimwear garment with the detachable skirt in an attached stated (as shown in FIGS. 1 and 4. Alternatively or additionally, the user may wear the garment with the skirt in a detached state, such that the skirt is not worn and the garment appears as a normal bikini. The user may alternate between wearing the garment with the skirt in the attached state and the detached state based on the users desires, outside factors (e.g., clothing dress codes at a location at which the user is present), or a variety of other factors.

IV. CLAIMS

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The following is claimed:

1. A garment system, comprising:

a bikini top having a cover portion configured to cover at least a portion of a wearer's bust;

a pair of attachment point rings integrated into the bikini top and disposed adjacent to a central line of symmetry at a front portion of the bikini top; and a detachable skirt comprising:

a truncated upper peripheral edge, a first curved edge depending from a first corner of the upper peripheral edge, a second curved edge depending from a second corner of the upper peripheral edge, opposite the first corner, and a pair of clasps, a first clasp of the pair of clasps disposed at the first corner of the upper peripheral edge of the skirt and a second clasp of the pair of clasps disposed at the second corner of the upper peripheral edge of the skirt, wherein the first clasp and the second clasp are configured to cooperate with a corresponding one of the pair of attachment rings, respectively, on the bikini top to detachably connect the detachable skirt to the bikini top.

2. The garment system of claim 1, wherein the bikini top is formed from a material selected from the group consisting of: woven fabric, non-woven fabric, leather, and latex.

3. The garment system of claim 1, wherein the pair of attachment rings are sewn into a portion of the bikini top below a bust line of the bikini top.

4. The garment system of claim 1, wherein the detachable skirt is formed from a material selected from the group consisting of: woven fabric, non-woven fabric, sheer material, mesh, lace, latex, and leather.

5. The garment system of claim 1, wherein the bikini top and the detachable skirt are formed from the same material.

6. The garment system of claim 1, wherein the detachable skirt is configured to cover an abdomen or stomach of the wearer and at least a portion of the legs of the wearer, while the detachable skirt is attached to the bikini top.

7. The garment system of claim 1, wherein the pair of attachment rings of the bikini top are disposed at a lower peripheral edge of the bikini top.

8. The garment system of claim 1, wherein the pair of clasps on the detachable skirt are configured to correspond to the pair of attachment rings, allowing for symmetrical attachment of the detachable skirt to the bikini top.

9. The garment system of claim 1, wherein the detachable skirt is configured to be attached to and detached from the bikini top while the bikini top is being worn by a user.

10. A garment, comprising;

a bikini top configured to be worn by a user to over at least a portion of the user's bust, the bikini top including a plurality of metallic rings permanently affixed to the bikini top; and a skirt configured to be selectively worn by a user, the skirt comprising:

a truncated upper peripheral edge:

a first curved edge depending from a first corner of the upper peripheral edge;

a second curved edge depending from a second corner of the upper peripheral edge opposite the first corner; and a plurality of clasps affixed to the skirt along the truncated upper peripheral edge, a first clasp of the plurality of clasps disposed at the first corner of the upper peripheral edge of the skirt and a second clasp of the plurality of clasps disposed at the second corner of the upper peripheral edge of the skirt, each clasp of the plurality of clasps respectively configured to selectively attach to the bikini top at a corresponding one of the plurality of rings, wherein when the user wears the bikini top and the skirt is attached to the bikini top, the skirt is configured to cover at least a portion of a pelvis of the user.

11. The garment of claim 10, wherein attachment of each clasp of the plurality of clasps respectively to the corresponding one of the plurality of metallic rings is configured to allow for symmetrical attachment of the skirt to the bikini top.

12. The garment of claim 10, wherein the plurality of clasps are disposed along an upper peripheral edge of the skirt.

13. The garment of claim 10, wherein the skirt is configured to be detachable from the bikini top while the bikini top is being worn by the user.

* * * * *